US007975391B1

(12) United States Patent
Gillingham et al.

(10) Patent No.: US 7,975,391 B1
(45) Date of Patent: Jul. 12, 2011

(54) ARCHERY SIGHT LEVELING DEVICE

(75) Inventors: Timothy J. Gillingham, Provo, UT (US); Shawn A. Greathouse, Johnstown, CO (US); Andrew Munsell, Brighton, CO (US)

(73) Assignee: Hamskea Archery Solutions, L.L.C., Johnstown, CO (US)

( * ) Notice: Subject to any disclaimer, the term of this patent is extended or adjusted under 35 U.S.C. 154(b) by 0 days.

(21) Appl. No.: 12/925,878

(22) Filed: Nov. 1, 2010

Related U.S. Application Data

(60) Provisional application No. 61/337,174, filed on Jan. 25, 2010, provisional application No. 61/280,500, filed on Nov. 5, 2009.

(51) Int. Cl.
*F41G 1/467* (2006.01)

(52) U.S. Cl. ..... 33/265; 124/87

(58) Field of Classification Search ..... 33/265; 124/86–87

See application file for complete search history.

(56) References Cited

U.S. PATENT DOCUMENTS

| | | | | |
|---|---|---|---|---|
| 5,303,479 | A * | 4/1994 | Rudovsky | 33/265 |
| 7,581,325 | B1 * | 9/2009 | Willman et al. | 33/265 |
| 2011/0023311 | A1 * | 2/2011 | Williams | 33/265 |

* cited by examiner

*Primary Examiner* — Yaritza Guadalupe-McCall
(74) *Attorney, Agent, or Firm* — Emery L. Tracy

(57) ABSTRACT

An archery sight leveling device for assessing the third axis of an archery sight of a bow system is provided. The bow system has at least one vertical reference. The archery sight leveling device comprises a main body with at least one rod receiving aperture formed through the main body. A sighting rod is receivable in the at least one rod receiving aperture with the sighting rod having a first end and a second end. A securing mechanism releasably secures the sighting rod in the at least one rod receiving aperture. A mounting mechanism mounts the main body to the bow system with the sighting rod being parallel to the bow string and the first end and the second end of the sighting rod extending beyond opposite sides of the archery sight. The first end and second end of the sighting rod are alignable to an external vertical frame of reference such that during full draw at an up or downward angle, the third axis of the archery sight aperture level is assessable thereby allowing offsetting of the bow system's dynamics at full draw versus the bow system at rest or static position.

20 Claims, 6 Drawing Sheets

ARCHERY SIGHT LEVELING DEVICE

The present application claims benefit of priority of provisional patent application Ser. No. 61/337,174, filed on Jan. 25, 2010, entitled "Archery Sight Leveling Device" and provisional patent application Ser. No. 61/280,500, filed Nov. 5, 2009, entitled "Archery Sight Leveling Device".

BACKGROUND OF THE INVENTION

1. Field of the Invention

The present invention relates generally to an archery sight leveling device and, more particularly, the present invention relates to an archery sight leveling device for assessing the third axis of an archery sighting system when mounted to an element of the archery systems (sight or bow riser) for a compound, recurve, or cross bow at full draw.

2. Description of the Prior Art

Archers have always looked for ways to further increase the accuracy of the archery system (bow, arrows, string, arrow rest, sight aides, stabilizers and operator). Specific to sights, it has long been recognized that the perpendicularity of the vertical sight plane to the aperture is critical in achieving the most accurate archery system. Modern archery sights have a variety of methods for adjusting for these variables but have no method for assessing them relative to a user defined reference or one the bow has been drawn (a.k.a. at full draw).

Methods for assessing the perpendicularity of the sight axes ($1^{st}$, $2^{nd}$ and $3^{rd}$) are known, but these methods rely on devices that hold the bow in a static position (i.e., at rest). Once static, a level can be used to true the first axis (string, bow riser, archery sight vertical bar) perpendicular to the tangent for that point on the earth. This method does not nor cannot account for the affects of the archery system at full draw. Devices exist for assessing an archery system at full draw but rely on a coupled force compensator that sets the level vial for truth.

Accordingly, there exists a need for an archery sight leveling device that is fixed in its reference to the reference plane ($1^{st}$ axis) making for a repeatable and simple way for archers to assess their sight's setting at all aspect angles (horizontal, up, or down hill). Additionally, a need exists for an archery sight leveling device allowing a quick, easy and repeatable assessment of an archer's sight and settings beyond the ideal conditions of an indoor archery range with associated supporting equipment (bow vise, Medicine Stone, and level). Furthermore, there exists a need for an archery sight leveling device that has no moving mechanical parts, provides repeatable results without adjustment, and allows for the archer to assess the archery system at full draw.

SUMMARY

The present invention is an archery sight leveling device for assessing the third axis of an archery sight of a bow system. The bow system has a bow riser and a bow string with the archery sight is mounted to the bow riser. The archery sight leveling device comprises a main body with at least one rod receiving aperture formed through the main body. A sighting rod is receivable in at least one rod receiving aperture with the sighting rod having a first end and a second end. A securing mechanism releasably secures the sighting rod in the at least one rod receiving aperture. A mounting mechanism mounts the main body to the archery system with the sighting rod being parallel to the bow string and the first end and the second end of the sighting rod extending beyond opposite sides of the archery sight. The first end and second end of the sighting rod are alignable to an external vertical frame of reference such that during full draw at an up or downward angle, the third axis of the archery sight aperture level is assessable thereby allowing offsetting the bow system's dynamics at full draw versus the bow system at rest or static position.

The present invention further includes a method for assessing the third axis of an archery sight of a bow system. The bow system has a bow riser and a bow string with the archery sight mounted to the bow riser. The method comprises providing a main body, forming at least one rod receiving aperture formed through the main body, inserting a sighting rod into the at least one rod receiving aperture with the sighting rod having a first end and a second end, releasably securing the sighting rod in at least one rod receiving aperture, mounting the main body to the archery system and adjusting it with the sighting rod parallel to a user define bow system vertical reference (bowstring, archery sight vertical element, bow axle-to-axle line), extending the first end and the second end of the sighting rod beyond opposite sides of the archery sight, aligning the first end and second end of the sighting rod to an external vertical frame of reference, assessing the third axis of the archery sight during full draw at an up or downward angle, and allowing offset accounting of the bow system's dynamics at full draw versus the bow system at rest or static position.

DETAILED DESCRIPTION OF THE PREFERRED EMBODIMENTS

Figure 1:
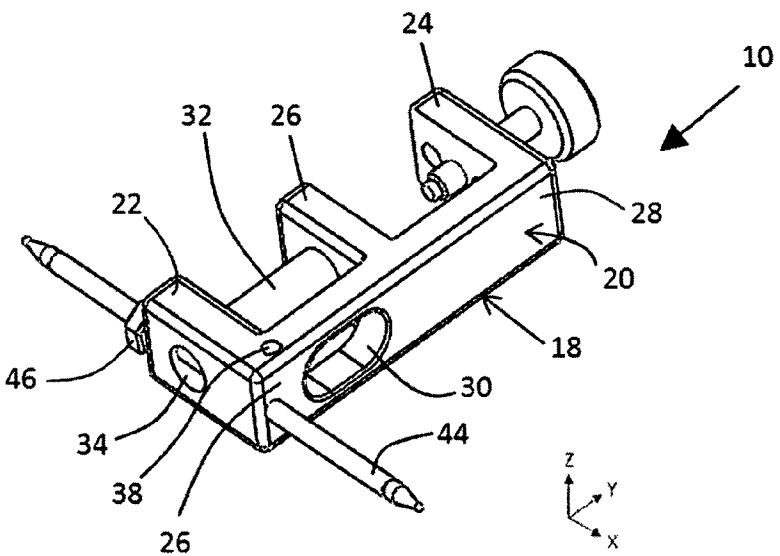
FIG. 1 is a perspective view illustrating an archery sight leveling device, constructed in accordance with the present invention.
Figure 2:
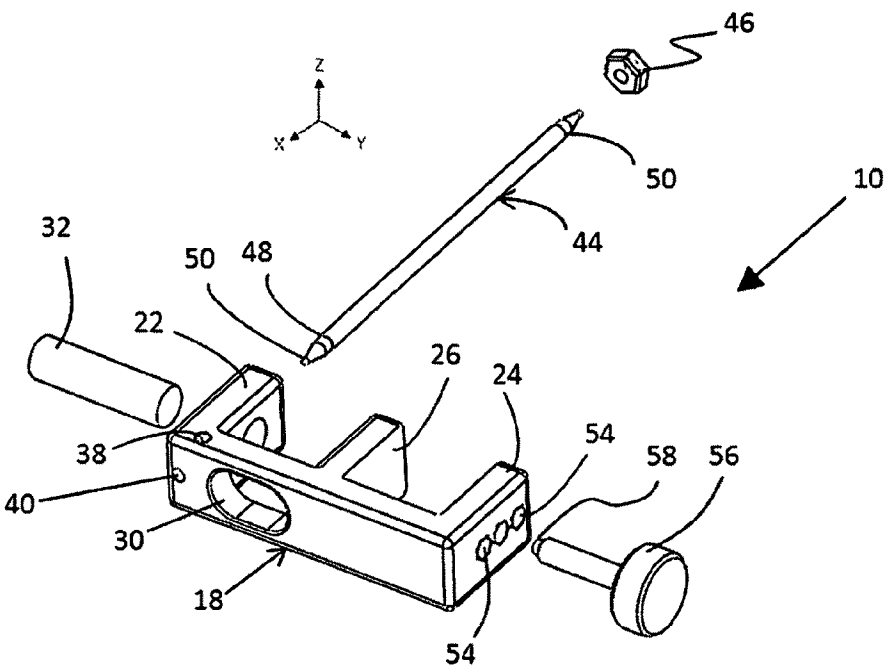
FIG. 2 is an exploded perspective view illustrating the archery sight leveling device, constructed in accordance with the present invention.
Figure 4:
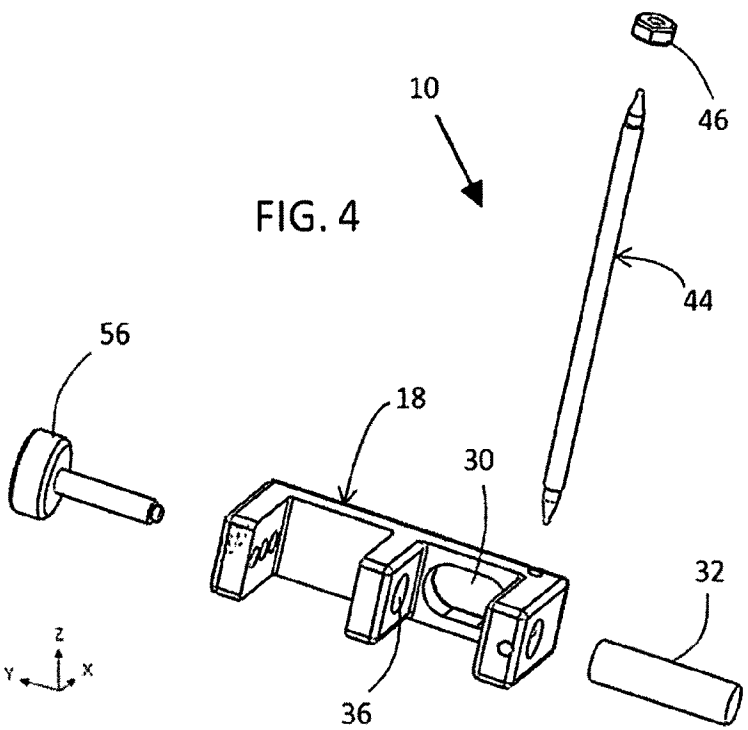
FIG. 4 is still another exploded perspective view illustrating the archery sight leveling device, constructed in accordance with the present invention.
Figure 3:
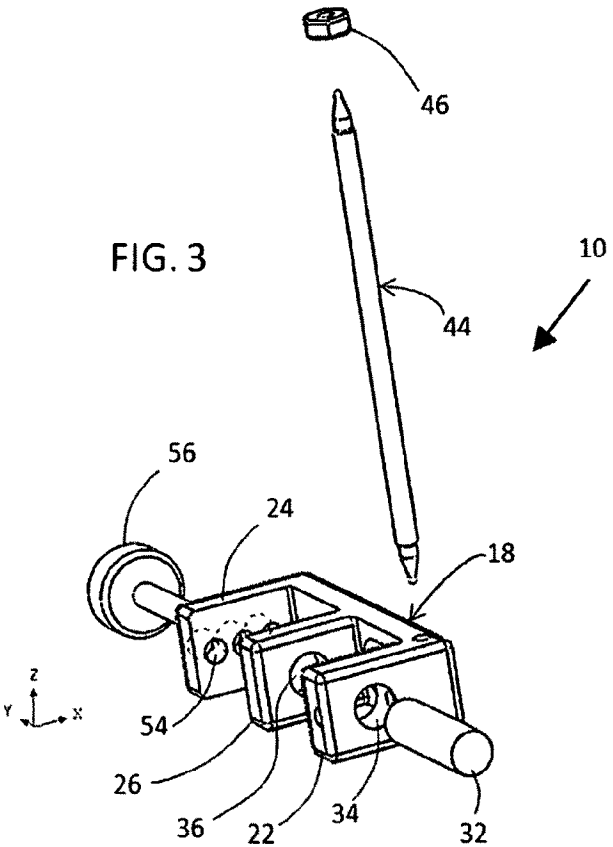
FIG. 3 is another exploded perspective view illustrating the archery sight leveling device, constructed in accordance with the present invention.
Figure 6:
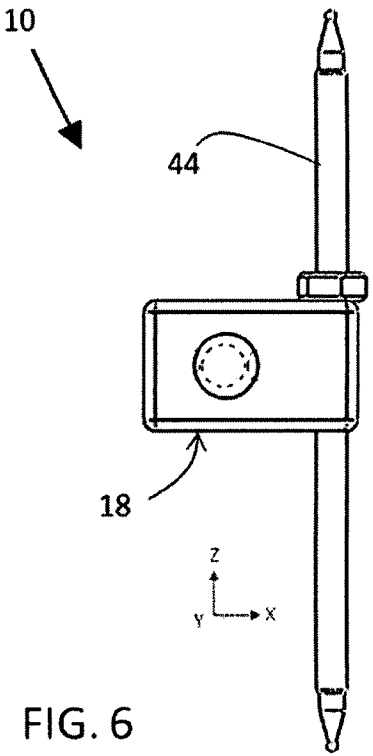
FIG. 6 is a first end view illustrating the archery sight leveling device, constructed in accordance with the present invention.
Figure 5:
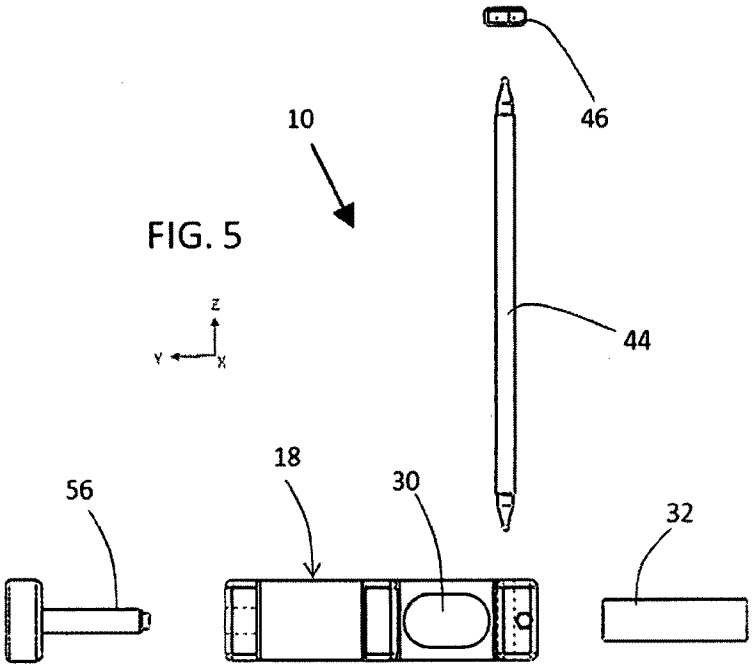
FIG. 5 is an exploded elevational front view illustrating the archery sight leveling device, constructed in accordance with the present invention.
Figure 8:
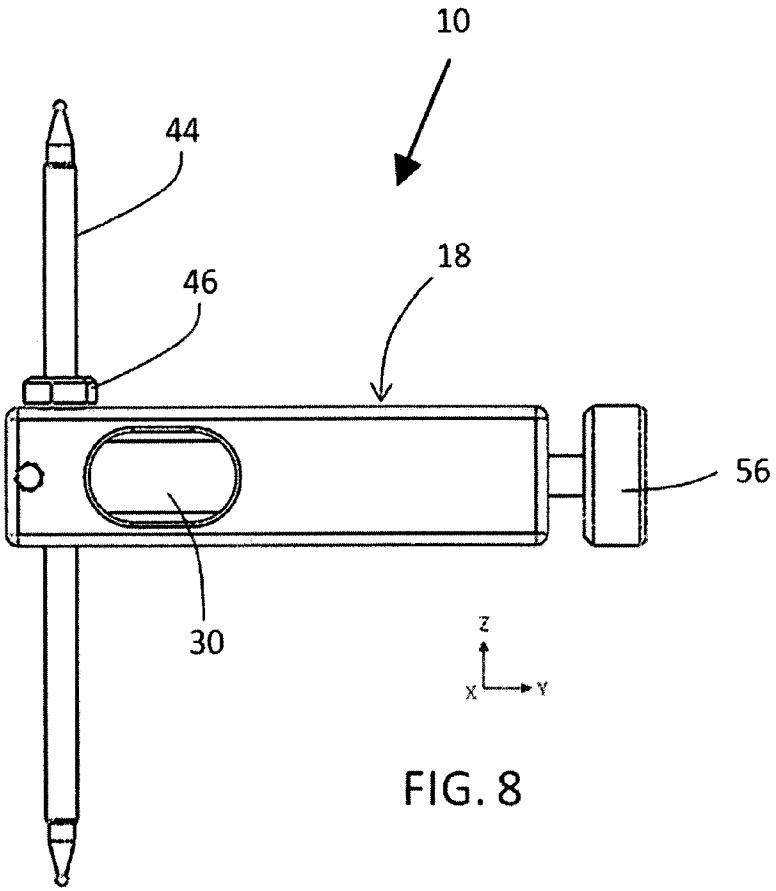
FIG. 8 is an elevational rear view illustrating the archery sight leveling device, constructed in accordance with the present invention.
Figure 7:
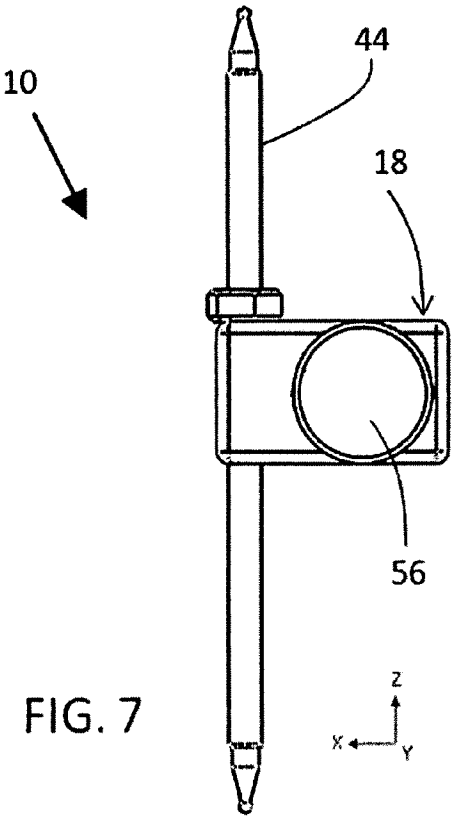
FIG. 7 is a second end view illustrating the archery sight leveling device, constructed in accordance with the present invention.
Figure 10:
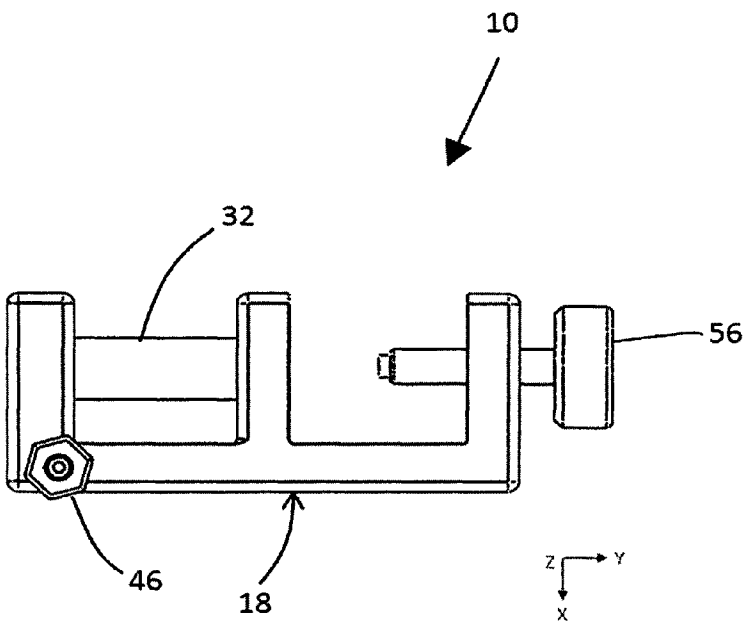
FIG. 10 is a first elevational side view illustrating the archery sight leveling device, constructed in accordance with the present invention, with the sighting rod in a second position.
Figure 9:
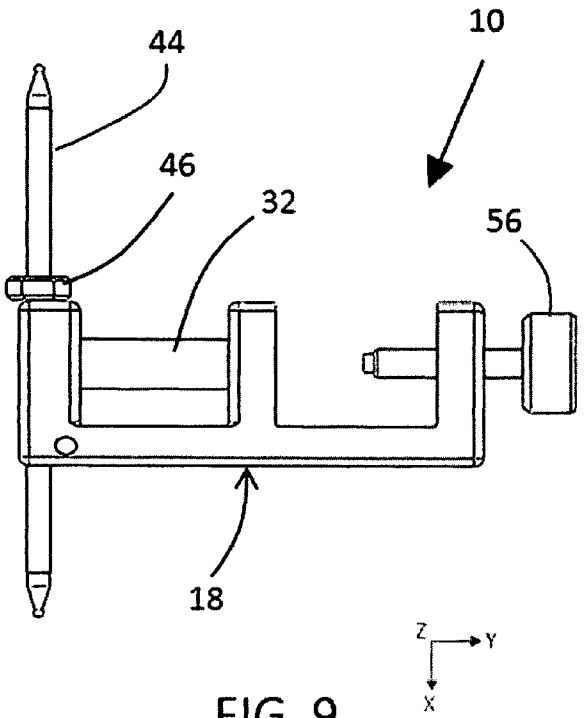
FIG. 9 is a first elevational side view illustrating the archery sight leveling device, constructed in accordance with the present invention, with the sighting rod in a first position.

As illustrated in FIGS. 1-11, the present invention is an archery sight leveling device, indicated generally at 10, for assessing the third axis of an archery sighting system when mounted to an element of the archery system 12 (archery sight 14 or bow riser 16) for a compound, recurve, or cross bow at full draw. The archery sight leveling device 10 of present invention provides a means for determining the orthoganality of an archery sight aperture to a reference plane that the archery sight leveling device 10 is mounted to and/or the travel of the arrow in the vertical plane. Once this is performed, the archery sight leveling device 10 can be placed in the same spot of the archery system 12 for subsequent assessments. This static reference point defined by the operator allows for the archery sight leveling device 10 to provide repeatable result from which an archer can assess the archery system's 12 accuracy relative to this starting condition.

The archery sight leveling device 10 of the present invention comprises a main body 18 having a main body portion 20, a first arm 22, a second arm 24, and a middle arm 26 between the first arm 22 and the second arm 24. The main body portion 20 has a first end 26 and a second end 28 with the first arm 22 mounted at the first end 26 of the main body portion 20 and the second arm 24 mounted at the second end 28 of the main body portion 20. The middle arm 26 is mounted between the first arm 22 and the second arm 24 preferably equidistant from the first arm 22 and the second arm 24 although mounting the middle arm 26 at any position between the first arm 22 and the second arm 24 is within the scope of the present invention. In addition, the first arm 22, the second arm 24, and the middle arm 26 are perpendicular to the main body portion 20 and parallel to each other.

The main body portion 20 of the main body 18 of the archery sight leveling device 10 of the present invention has a level sighting aperture 30 formed therethrough between the first arm 22 and the middle arm 26. Preferably, the level sighting aperture 30 has an elongated, substantially oval shape and allows a user to view a level vial 32 mounted to the main body 18, as will be described in further detail below.

The first arm 22 of the main body 18 of the archery sight leveling device 10 of the present invention has a level receiving aperture 34 formed therethrough for receiving the level vial 32. The level vial 32 is inserted through the level receiving aperture 34 and is seated in a receiving bore 36 formed in, but not completely through, the middle arm 26. Preferably, the level vial 32 is substantially perpendicular to the first arm 22 and the middle arm 26 and substantially parallel to the main body portion 20. Further, the level vial 32 is preferably held in place via a friction fit although using other means such as adhesive, etc., is within the scope of the present invention.

In addition, the first arm 22 of the main body 18 of the archery sight leveling device 10 of the present invention has a first rod receiving aperture 38 formed through the main body portion 20 adjacent the first end 22 of the main body portion 20 and a second rod receiving aperture 40 formed through the first arm 22 and the main body portion 20 substantially perpendicular to the main body portion 20 and substantially parallel to the first arm 22.

The first and second rod receiving apertures 38, 40 are sized and shaped for receiving a sighting rod 44. Preferably, the first and second rod receiving apertures 38, 40 are each threaded with the sighting rod 44 having corresponding threads. In this embodiment, the sighting rod 44 is threadably receivable in either the first rod receiving aperture 38 or the second rod receiving aperture 40. A nut 46 is then threadable over the sighting rod 44 and seated against either the first arm 22 or the main body portion 20 to releasably secure the sighting rod 44 in position. It is within the scope of the present invention for the sighting rod 44 an be releasably secured within either the first or second receiving aperture 38, 40 by other means including, but not limited to, friction, bolts, thumb screws, etc.

The sighting rod 44 of the archery sight leveling device 10 of the present invention has a first end 48 and a second end 50. Preferably, both the first end 48 and the second end 50 of the sighting rod 44 narrows in a general direction inward with a bead sight 52 secured to both the first end 48 and the second end 50 of the sighting rod 44. Using the first end 48 and the second end 50 of the sighting rod 44, the sighting rod 44 defines two points within a vertical plane outside the archery sight for use in assessing the third axis of an archery sighting system. Use and operation of the sighting rod 44 will be described in further detail below.

The second arm 24 of the main body 18 of the archery sight leveling device 10 of the present invention has a series of threaded screw receiving apertures 54 formed through and along the length of the second arm 24. Each of the threaded screw receiving apertures 54 is sized and shaped for receiving a correspondingly threaded thumb screw 56 or the like. Preferably, the thumb screw 56 is substantially perpendicular to the second arm 24 and the middle arm 26 and substantially parallel to the main body portion 20. Further, the thumb screw 56 threads into and through a selected threaded screw receiving aperture 54 and tightened against a portion of the archery system 12 thereby releasably securing the main body 18 to the archery system 12 with the sighting rod 44 adjusted to be parallel to a user defined vertical reference (bowstring, archery sight vertical element, bow axle-to-axle line), as will be described in further detail below. A malleable tip 58 can be applied to the thumb screw 56 to inhibit damage to the archery system 12. In a preferred embodiment, the second arm 24 has three threaded screw receiving apertures 54 although having more than three threaded screw receiving apertures 54 or less than three threaded screw receiving apertures 54 is within the scope of the present invention.

Preferably, the main body 18 of the archery sight leveling device 10 of the present invention including the main body portion 20, the first arm 22, the second arm 24, and the middle arm 26, is constructed from a single piece of precision machined steel material although constructing the main body 18 from multiple pieces and other materials is within the scope of the present invention. All surfaces of the main body 18 are either parallel or orthogonal to one another as matter of design and construction.

The surfaces between the second arm 24 and the middle arm 26 of the main body 18 of the archery sight leveling device 10 of the present invention enables the archery sight leveling device 10 to be positioned coplanar to one of the archery system's planes. The two planes most commonly used are the vertical bar of the sight 14 and the bow riser 16. The axis of the level vial of the archery sight leveling device 10 is normal to the surfaces between the second arm and the middle arm, which now provides the reference frame relative to the mounting point, known as "truth". Since the archery sight leveling device 10 is mounted within the archery system 12, the archery sight leveling device 10 can now be used when the archery system 12 is at full draw with all the force inputs included (bow torque, accessories, and user). The archery sight leveling device 10 uses a defined plane parallel to the archery system's $1^{st}$ axis by use of establishing two points (i.e., the first end 48 and the second end 50 of the sighting rod 44) in a parallel plane. These two points now define a physical, projected or imaginary, line that can now be aligned to an external vertical reference line. Once the mounted archery sight leveling device's 10 parallel plane is aligned to the external vertical reference, the system' $3^{rd}$ axis can then be assessed at full draw. The archery system at full draw can now be tilted in the plane of reference ($1^{st}$ axis) to assess the sight's $3^{rd}$ axis orthogonality relative to this external vertical reference.

Figure 11:
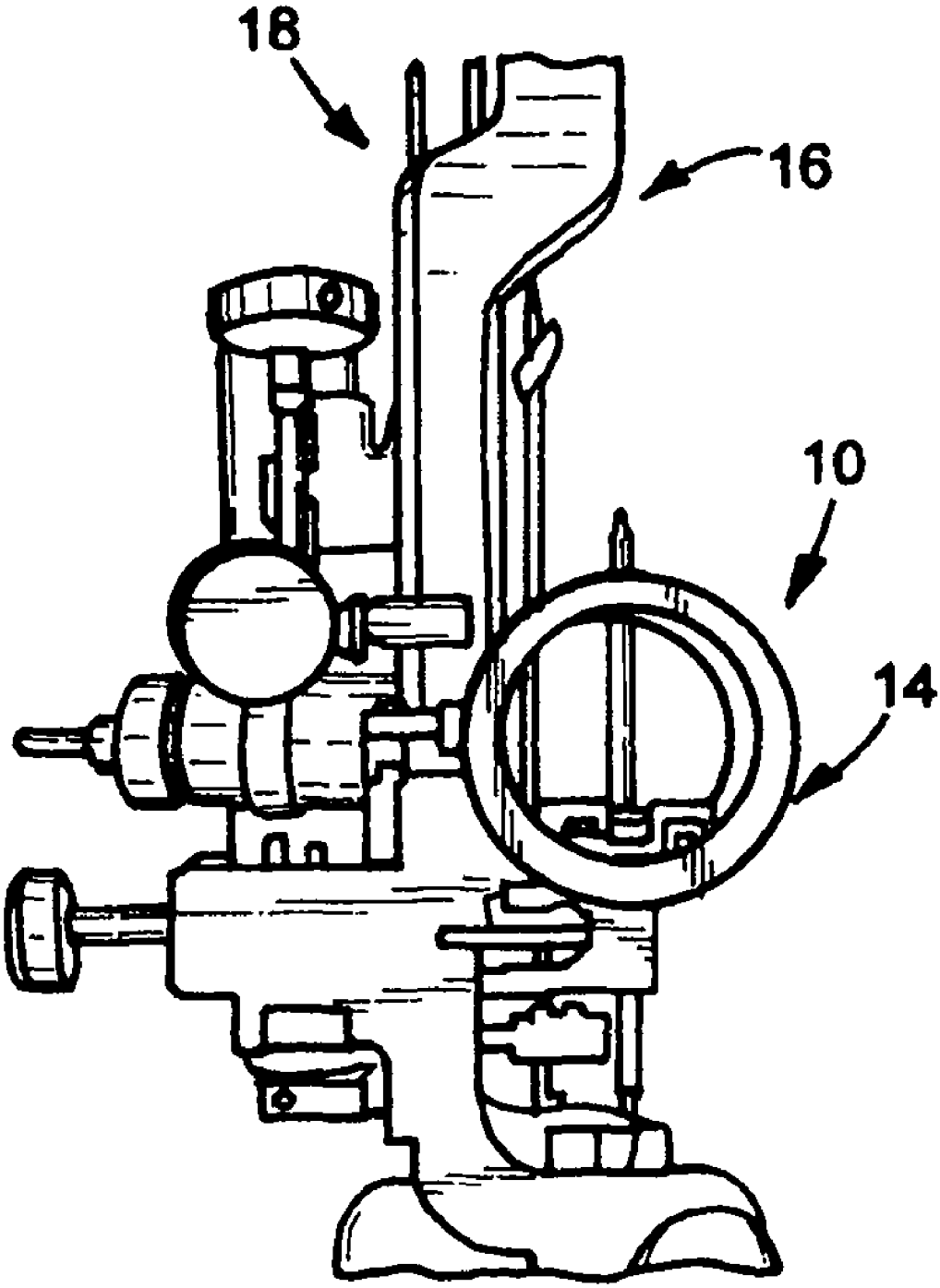
FIG. 11 is a perspective view illustrating the archery sight leveling device, constructed in accordance with the present invention, mounted on an archery system.

For purposes of example of operation of the archery sight leveling device 10 of the present invention, FIG. 11 illustrates the bow system comprising of a compound bow and a conventional sight assembly referenced to a Cartesian coordinate system. The sight assembly 14 is typically mounted to the compound bow handle or bow riser 16. The coordinate system illustrates the relationship between the archery sight leveling device 10 of the present invention and the archery system in 12 a common three dimensional space.

The archery sight leveling device 10 of the present invention is mounted to a reference structure (i.e., the bow riser 16 or the vertical sight bar) of the target sight assembly. The reference structure is placed between the second arm 24 and the middle arm 26 and the threaded thumb screw 56 is turned clockwise. The threaded thumb screw 56 then clamps the main body 18 to the reference structure of the archery system 18. Once secure, the surfaces are coplanar with the level vial axis orthogonal to the mated planes. Assuming the mated surfaces are parallel to the ZX plane defined in the reference coordinate system, the level vial axis is pointing along the Y axis of the reference coordinate frame. Once established, this relationship can be repeated.

Mounted to the reference structure with mating surface parallel to the Z axis, the archery sight leveling device 10 of the present invention is now part of the archery system 12. With the system vertically referenced to the ZX plane, the archery system 12 can now be rotated about the Y axis in the ZX plane. The archery sight's orthogonality can be checked against the level vial of the archery sight leveling device 10 and adjusted accordingly. The archery sight leveling device 10 has fixed geometry lending itself to being a repeatable reference to the point at which it was initially mounted.

Once the archery sight leveling device 10 is mounted, an imaginary line made by the two end points 48, 50 of the sighting rod 44 is parallel to the structure in the first axis, ZX plane with the points extending beyond the scope of the archery sight 14. This relationship is mechanical in nature and is not susceptible to the effects of gravity like a level vial. These two points and the line (imaginary, projected or physical) they define can now be aligned with any external vertical reference (i.e. another line, plumb bob, etc.) in the ZX plane. Since the line defined by the sighting rod 44 is a line, it translates the mounting surface's (i.e. bow riser or sight first axis) relative position to the external vertical line in the ZX plane without the two planes having to remain parallel. When the archery system 12 is rotated about the Y axis, the third axis setting can be assessed by viewing the level bubble in the scope and subsequently adjusted.

The relative position in angle of the archery system 12 about the Z axis where the X axis is defined to be 0 degrees changes between static and full draw. The third axis, which was once parallel to the YZ plane, is no longer. When shooting up or down hill, this non-parallel condition causes the bubble vial in the sight to give an inaccurate indication of this parallel relationship. The archery sight leveling device 10 enables the vertical position of the archery system 12 to be referenced to an external vertical reference thereby giving true geometric alignment from which the third axis setting can be changed to compensate for this difference between static and full draw. In other words, the archery sight leveling device 10 nullifies the affects of the difference between static and full draw as observed in the third axis. The result is the third axis plane is perpendicular to the line of travel in the X direction of the coordinate system for the projective arrow.

In sum, the archery sight leveling device 10 of the present invention provides a fixed orthogonal three axes reference frame from which an adjustable conventional archery sight can then be adjusted to match. The archery sight leveling device 10 uses geometric planes inherent in the structures of an archery system 12 (bow, string, sight, stabilizer, arrow, etc). Once the archery sight leveling device 10 is mounted to an archery bow system structure that relates to a plane of interest (usually the vertical sight bar of a movable archery sight or the bow riser), it allows for the assessment of the archery sight settings ($2^{nd}$ and $3^{rd}$ axis) relative to the first axis (i.e. vertical bow sight frame or any vertical bow surface defining the plane of interest) from which adjustments can be made to the archery sight 14. The archery sight leveling device 10 allows for these assessments and subsequent adjustments without the aid or use of additional equipment (e.g. bow vise, Medicine Stone, leveling devices, etc.) that are used to statically hold, reference, and assess the bow system either at rest or at full draw. The archery sight leveling device 10 mounts to any structure in the bow system (bow riser, limb stabilizer, sighting device) parallel to the bow string establishing a vertical mechanical frame of reference that can be aligned to an any external vertical frame of reference during full draw at an up or downward angle from which once these two vertical references are aligned, the user can assess the third axis of their archery sighting system and make the appropriate adjustments to their system to account for the offset of the bows dynamics at full draw versus the bow at rest or static position.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. An archery sight leveling device for assessing the third axis of an archery sight of a bow system, the bow system having at least one vertical reference, the archery sight leveling device comprising:

a main body;

at least one rod receiving aperture formed through the main body;

a sighting rod receivable in the at least one rod receiving aperture, the sighting rod having a first end and a second end;

securing means for releasably securing the sighting rod in the at least one rod receiving aperture; and mounting means for mounting the main body to the bow system with the sighting rod being parallel to at least one of the vertical references of the bow system, the first end and the second end of the sighting rod extending beyond opposite sides of the archery sight;

wherein the first end and second end of the sighting rod are alignable to an external vertical frame of reference; and wherein during full draw at an up or downward angle, the third axis of the archery sight aperture level being assessable thereby allowing offset accounting of the bow system's dynamics at full draw versus the bow system at rest or static position.

2. The archery sight leveling device of claim 1 and further comprising:

an elongated level vial sighting aperture formed in the main body perpendicular to the sighting rod;

a level receiving aperture formed in the main body;

a receiving bore formed in the main body aligned with the level receiving aperture; and a level vial insertable through the level receiving aperture and seatable in the receiving bore;

wherein the level vial is perpendicular to the sighting rod allowing a user to determine when sighting rod is in vertical position.

3. The archery sight leveling device of claim 1 wherein both the first end and the second end of the sighting rod narrows in a general direction inward, and further comprising:

a first bead sight secured to first end of the sighting rod; and a second bead sight secured to the second end of the sighting rod.

4. The archery sight leveling device of claim 1 wherein the mounting means is at least one threaded screw receiving aperture formed through the second arm and a threaded thumb screw threadably receivable in the at least one threaded screw receiving aperture, the thumb screw tightenable against a portion of the bow system thereby releasably securing the main body to the bow system.

5. The archery sight leveling device of claim 1 and further comprising:

a series of three threaded screw receiving apertures.

6. A method for assessing the third axis of an archery sight of a bow system, the bow system having at least one vertical reference, the method comprising:

providing a main body;

forming at least one rod receiving aperture formed through the main body;

inserting a sighting rod into the at least one rod receiving aperture, the sighting rod having a first end and a second end;

releasably securing the sighting rod in the at least one rod receiving aperture;

mounting the main body to the bow system with the sighting rod parallel to at least one of the vertical references of the bow system;

extending the first end and the second end of the sighting rod beyond opposite sides of the archery sight;

aligning the first end and second end of the sighting rod to an external vertical frame of reference;

assessing the third axis of the archery sight aperture level during full draw at an up or downward angle; and accounting for offset the bow system's dynamics at full draw versus the bow system at rest or static position.

7. The method of claim 6 and further comprising:

forming an elongated level vial sighting aperture in the main body portion between the first arm and the middle arm and substantially perpendicular to the sighting rod;

forming a level receiving aperture through the first arm;

forming a receiving bore in the middle arm;

aligning the receiving bore with the level receiving aperture;

inserting a level vial through the level receiving aperture;

seating the level vial in the receiving bore perpendicular to the sighting rod; and determining when sighting rod is in vertical position.

8. The method of claim 6 and further comprising:

narrowing the first end and the second end of the sighting rod in a general direction inward;

securing a first bead sight to first end of the sighting rod; and securing a second bead sight to the second end of the sighting rod.

9. The method of claim 6 and further comprising:

forming at least one threaded screw receiving aperture through the second arm;

threading a threaded thumb screw into the at least one threaded screw receiving aperture;

tightening the thumb screw against a portion of the bow system; and releasably securing the main body to the bow system.

10. The method of claim 9 and further comprising:

forming a series of three threaded screw receiving apertures.

11. An archery sight leveling device for assessing the third axis of an archery sight of a bow system, the bow system having at least one vertical reference, the archery sight leveling device comprising:

a main body having a main body portion, a first arm, a second arm, and a middle arm between the first arm and the second arm, the main body portion having a first end and a second end with the first arm mounted at the first end of the main body portion and the second arm mounted at the second end of the main body portion, the middle arm mounted between the first arm and the second arm;

a first rod receiving aperture formed through the main body portion adjacent the first end of the main body portion;

a second rod receiving aperture formed through the first arm and the main body portion substantially perpendicular to the main body portion and substantially parallel to the first arm;

a sighting rod alternatingly receivable in the first and second rod receiving apertures, the sighting rod having a first end and a second end;

securing means for releasably securing the sighting rod in the at least one rod receiving aperture; and mounting means for mounting the main body to the bow system and adjusting the main body, the sighting rod being parallel to the at least one vertical reference of the bow system;

wherein upon mounting of the main body to the bow system, the first end and second end of the sighting rod are alignable to an external vertical frame of reference during full draw at an up or downward angle thereby assessing the third axis of the archery sight aperture level and allowing for offset of the bow system's dynamics at full draw versus the bow system at rest or static position.

12. The archery sight leveling device of claim 11 and further comprising:

a level vial sighting aperture formed in the main body portion between the first arm and the middle arm and substantially perpendicular to the sighting rod;

a level receiving aperture formed through the first arm;

a receiving bore formed in the middle arm, the receiving bore aligned with the level receiving aperture; and a level vial insertable through the level receiving aperture and seatable in the receiving bore;

wherein the level vial is perpendicular to the sighting rod allowing a user to determine when sighting rod is in vertical position.

13. The archery sight leveling device of claim 12 wherein the level sighting aperture has an elongated, substantially oval shape allowing full view of the level vial.

14. The archery sight leveling device of claim 11 and further comprising:

a nut threadably over the sighting rod and seated against either the first arm or the second arm for releasably securing the sighting rod in a desired position.

15. The archery sight leveling device of claim 11 wherein both the first end and the second end of the sighting rod narrows in a general direction inward.

16. The archery sight leveling device of claim 11 and further comprising:

a first bead sight secured to first end of the sighting rod; and a second bead sight secured to the second end of the sighting rod.

17. The archery sight leveling device of claim 11 wherein the mounting means is at least one threaded screw receiving aperture formed through the second arm and a threaded thumb screw threadably receivable in the at least one threaded screw receiving aperture, the thumb screw tightenable against a portion of the bow system thereby releasably securing the main body to the bow system.

18. The archery sight leveling device of claim 17 and further comprising a malleable tip mounted on the thumb screw for inhibiting damage to the bow system.

19. The archery sight leveling device of claim 17 and further comprising:

a series of three threaded screw receiving apertures.

20. The archery sight leveling device of claim 11 wherein the first end and the second end extend beyond opposite sides of the archery sight.

* * * * *